US011276947B2

(12) United States Patent
Wydotis et al.

(10) Patent No.: US 11,276,947 B2
(45) Date of Patent: Mar. 15, 2022

(54) FEED THRU DISCONNECT/TEST TERMINAL BLOCK

(71) Applicant: Siemens Mobility, Inc., New York, NY (US)

(72) Inventors: Leonard Wydotis, Marion, KY (US); Zhenzhong Long, Louisville, KY (US); Barden J. Wing, New Albany, IN (US)

(73) Assignee: Siemens Mobility, Inc., New York, NY (US)

( * ) Notice: Subject to any disclaimer, the term of this patent is extended or adjusted under 35 U.S.C. 154(b) by 17 days.

(21) Appl. No.: 16/609,235

(22) PCT Filed: Nov. 6, 2017

(86) PCT No.: PCT/US2017/060141

§ 371 (c)(1),
(2) Date: Oct. 29, 2019

(87) PCT Pub. No.: WO2018/222221

PCT Pub. Date: Dec. 6, 2018

(65) Prior Publication Data

US 2020/0185841 A1 Jun. 11, 2020

Related U.S. Application Data

(60) Provisional application No. 62/512,854, filed on May 31, 2017.

(51) Int. Cl.
*H01R 9/22* (2006.01)
*H01R 9/26* (2006.01)
(Continued)

(52) U.S. Cl.
CPC ..... *H01R 9/2633* (2013.01); *H01R 9/2641* (2013.01); *H01R 13/74* (2013.01); *H01T 4/06* (2013.01)

(58) Field of Classification Search
CPC ..... H02H 1/0061; H01R 9/24; H01R 9/26; H01R 4/2429
(Continued)

(56) References Cited

U.S. PATENT DOCUMENTS 8,670,221 B2 * 3/2014 Gillespie ..... H01R 9/2433 361/118
2010/0112837 A1 5/2010 Lewis
(Continued)

FOREIGN PATENT DOCUMENTS

EP 3163703 A1 5/2017

OTHER PUBLICATIONS

PCT International Search Report and Written Opinion of International Searching Authority dated Feb. 8, 2018 corresponding to PCT International Application No. PCT/US2017/060141 filed Nov. 6, 2017.

*Primary Examiner* — Phuong Chi Thi Nguyen

(57) ABSTRACT

A disconnect/test terminal block may include a body including a front side and a back side including a protruding part. The block may include at least one circuit element disposed in the body. The block may include at least one case wire terminal disposed on the front side of the body and coupled to the at least one internal circuit. The block may include at least one field cable terminal disposed on the protruding part and coupled to the at least one internal circuit.

14 Claims, 12 Drawing Sheets

(51) Int. Cl.
*H01R 13/74* (2006.01)
*H01T 4/06* (2006.01)

(58) Field of Classification Search
USPC ..... 439/709, 716, 922
See application file for complete search history.

(56) References Cited

U.S. PATENT DOCUMENTS

| | | | |
|---|---|---|---|
| 2012/0081827 | A1 | 4/2012 | Gillespie et al. |
| 2015/0229065 | A1 | 8/2015 | Buehman et al. |

* cited by examiner

FEED THRU DISCONNECT/TEST TERMINAL BLOCK

BACKGROUND

Railroads include signaling and other wayside equipment. The equipment and/or control circuitry thereof is often housed in an instrument house or case. The case may contain a terminal board. Traditionally, many railroads use an Association of American Railroads (AAR) terminal connection on the terminal board. Some railroads use a connection supplied by the WAGO corporation (referred to herein as a "WAGO connection") instead of the AAR terminal. For example, the WAGO connection includes disconnect/test terminal blocks for mounting arresters and terminating case wire and field cable. The WAGO connection can be installed with less labor and can improve reliability in comparison to the AAR terminal connection.

FIGS. 1A and 1B illustrate a WAGO disconnect/test terminal block 10, where FIG. 1A shows a front side of block 10 and FIG. 1B shows a back side of block 10. Block 10 includes body 12 (which houses internal circuitry, not shown), terminals 14/15 for coupling wires to block 10 and internal circuitry, test switches 16, and mounting hardware 18 for mounting block 10 to a DIN rail.

FIG. 2 illustrates a terminal board 20 with WAGO blocks 10. Terminal board 20 includes low impedance ground plane 22 and DIN rail 26 to which blocks 10 are mounted. Case wire 24 is coupled to terminals 14/15 of blocks 10, and arrestors 40 are installed on each block 10. However, field cable 36 is available only on the back of terminal board 20. All terminals 14/15 of block 10 are on the front side of block 10. Accordingly, additional hardware is required to connect block 10 with field cable 36. Specifically, a plurality of feed through blocks 30 fit into holes 28 in ground plane 22. Feed through blocks 30 are coupled to ground plane 22 by spacer 34 and clip lock 38. Additional wires 32 couple terminals 14/15 of block 10 with feed through blocks 30 on the front of ground plane 22, and field cables 36 couple to feed through blocks 30 on the back of ground plane 22. The disadvantages of this wiring scheme include that two points of failure are introduced (i.e., there are two additional wire connections), and a great deal of labor and material are required for each board 20.

SUMMARY OF THE DISCLOSURE

Aspects described herein generally relate to connectors and devices for use in railway cars, railway systems, and other environments. In railway systems, and other systems, system installation, repair, and upgrade may involve wire and cable installation and connection. Improved connectors and devices may be desirable. Disclosed embodiments relate to connectors and devices for use in railway cars, railway systems, and other environments, and other devices, systems, and methods as disclosed herein.

Some embodiments may include a disconnect/test terminal block comprising a body including a front side and a back side including a protruding part. At least one circuit element may be disposed in the body. At least one case wire terminal may be disposed on the front side of the body and coupled to the at least one internal circuit. At least one field cable terminal may be disposed on the protruding part and coupled to the at least one internal circuit. The disconnect/test terminal block may further comprise at least one test switch. The disconnect/test terminal block may further comprise mounting hardware. The mounting hardware may be configured to mount the disconnect/test terminal block to a DIN rail. The mounting hardware may be coupled to the at least one internal circuit and configured to provide a ground path to an external ground. The protruding part may be configured to fit inside a hole on a ground plane on which the disconnect/test terminal block is mounted.

Some embodiments may include a system comprising at least one disconnect/test terminal block as described above and a terminal board. The terminal board may comprise a ground plane including a front side, a back side, and at least one hole protruding from the front side of the ground plane to the back side of the ground plane. Board mounting hardware may be coupled to the ground plane. The block mounting hardware of each at least one disconnect/test terminal block may be coupled to the board mounting hardware. The protruding part of each at least one disconnect/test terminal block may protrude through the at least one hole in the ground plane. At least one case wire may be disposed at the front side of the ground plane and coupled to the at least one case wire terminal. At least one field cable may be disposed at the back side of the ground plane and coupled to the at least one field cable terminal. The board mounting hardware may comprise at least one DIN rail. The block mounting hardware may be coupled to the at least one internal circuit and may be configured to provide a ground path to the board mounting hardware. The at least one field cable terminal may face perpendicular, parallel, or obliquely to a plane parallel to the back side of the ground plane.

DETAILED DESCRIPTION OF SEVERAL EMBODIMENTS

Embodiments disclosed herein may include terminal boards and terminal blocks configured so that a case wire may terminate on the front of the terminal board and a field cable may terminate on the back of the terminal board, and each of the case wire and field cable couple directly to a same block. A block as disclosed herein may have a field cable connection hole on the back, which may eliminate the need for the additional wire connections and feed though blocks. The disclosed block may include an internal ground path between the arrester and the DIN rail.

Figure 1A:
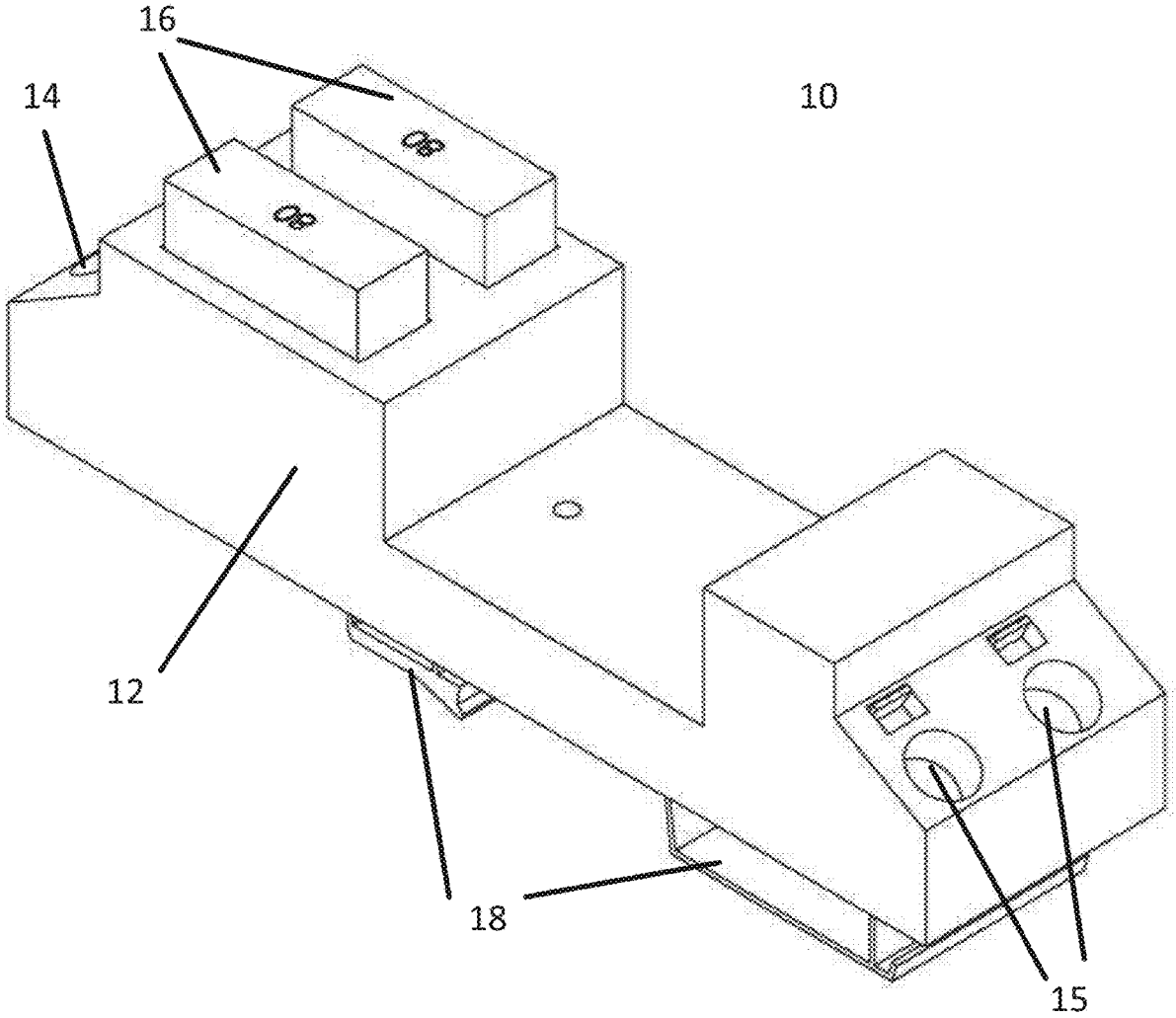
FIG. 1A (PRIOR ART)
FIGS. 1A and 1B illustrate a WAGO disconnect/test terminal block.
Figure 1B:
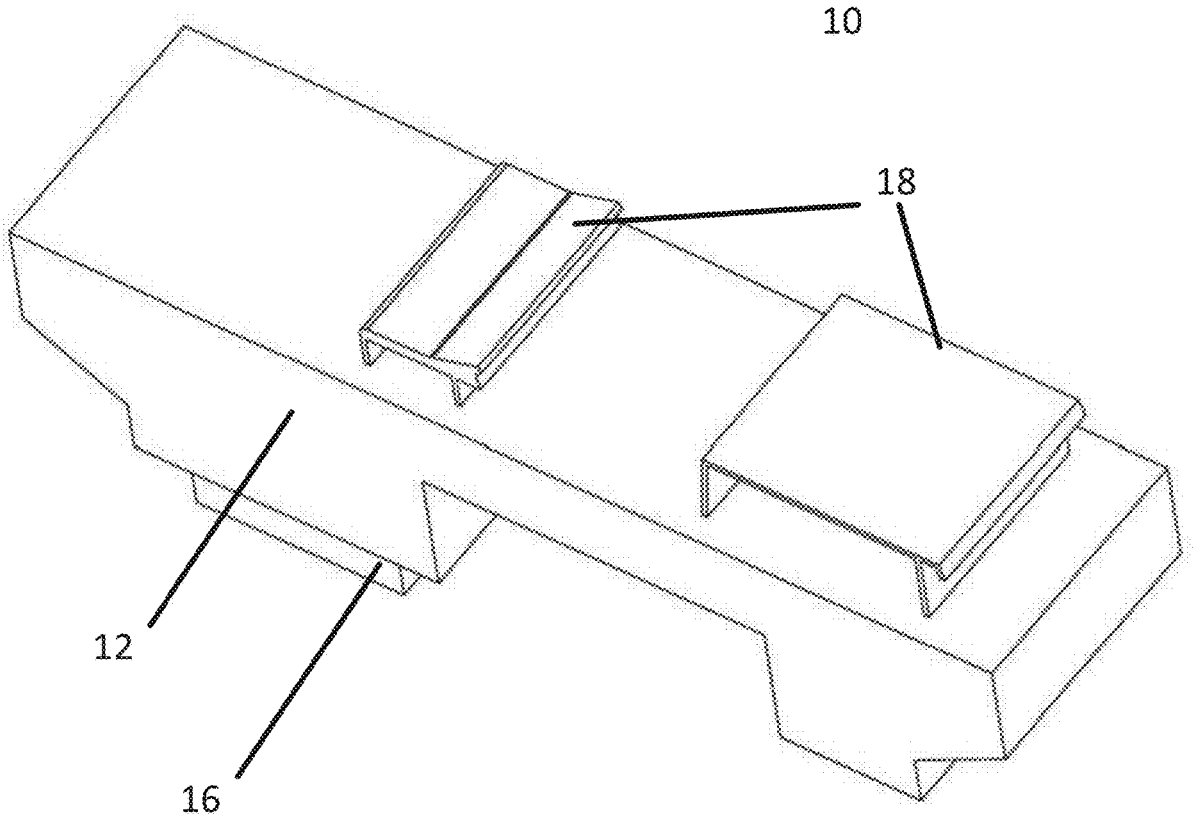
FIG. 1B (PRIOR ART)
Figure 2:
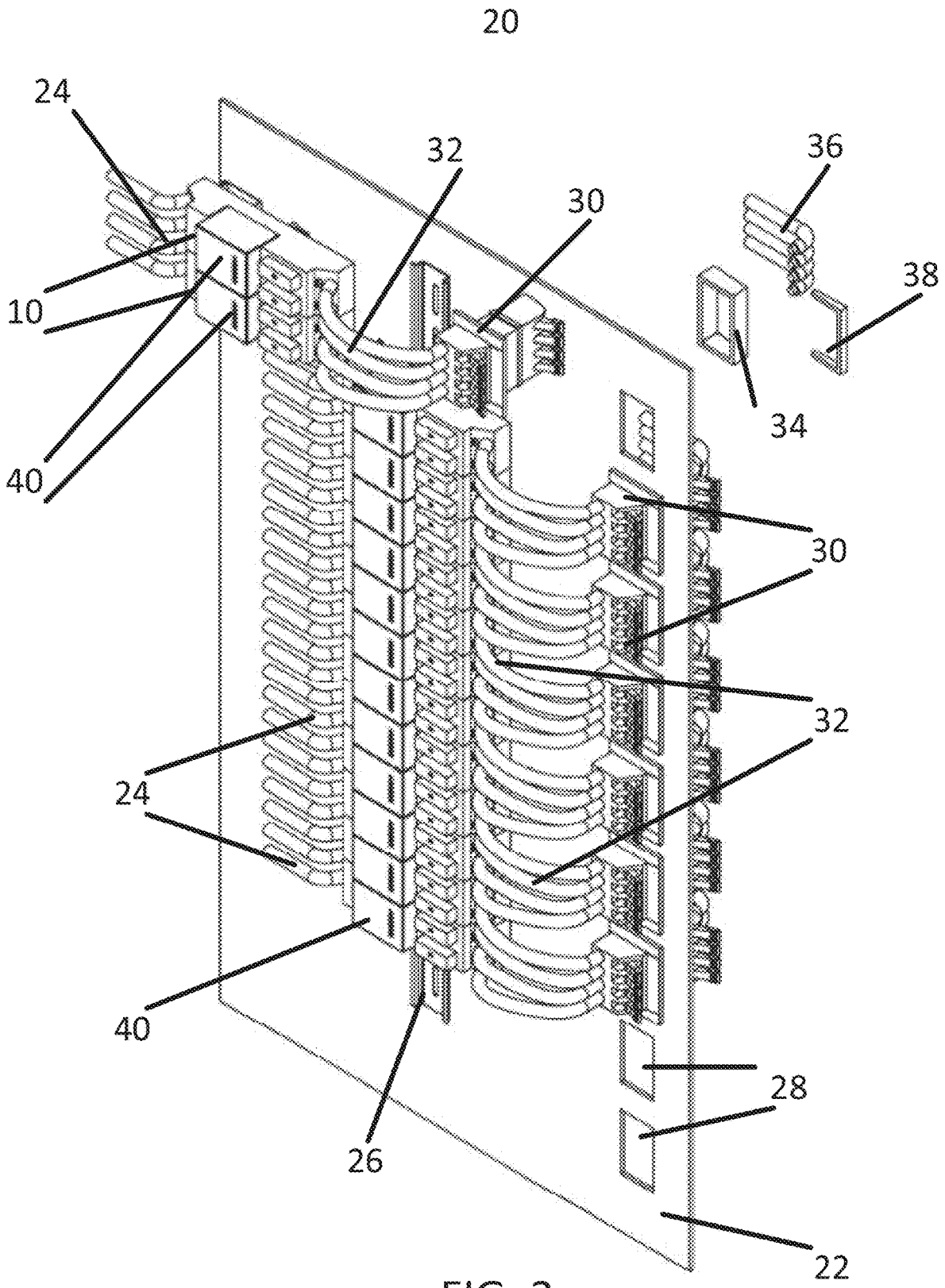
FIG. 2 (PRIOR ART)
FIG. 2 illustrates a terminal board with WAGO blocks.
Figure 3A:
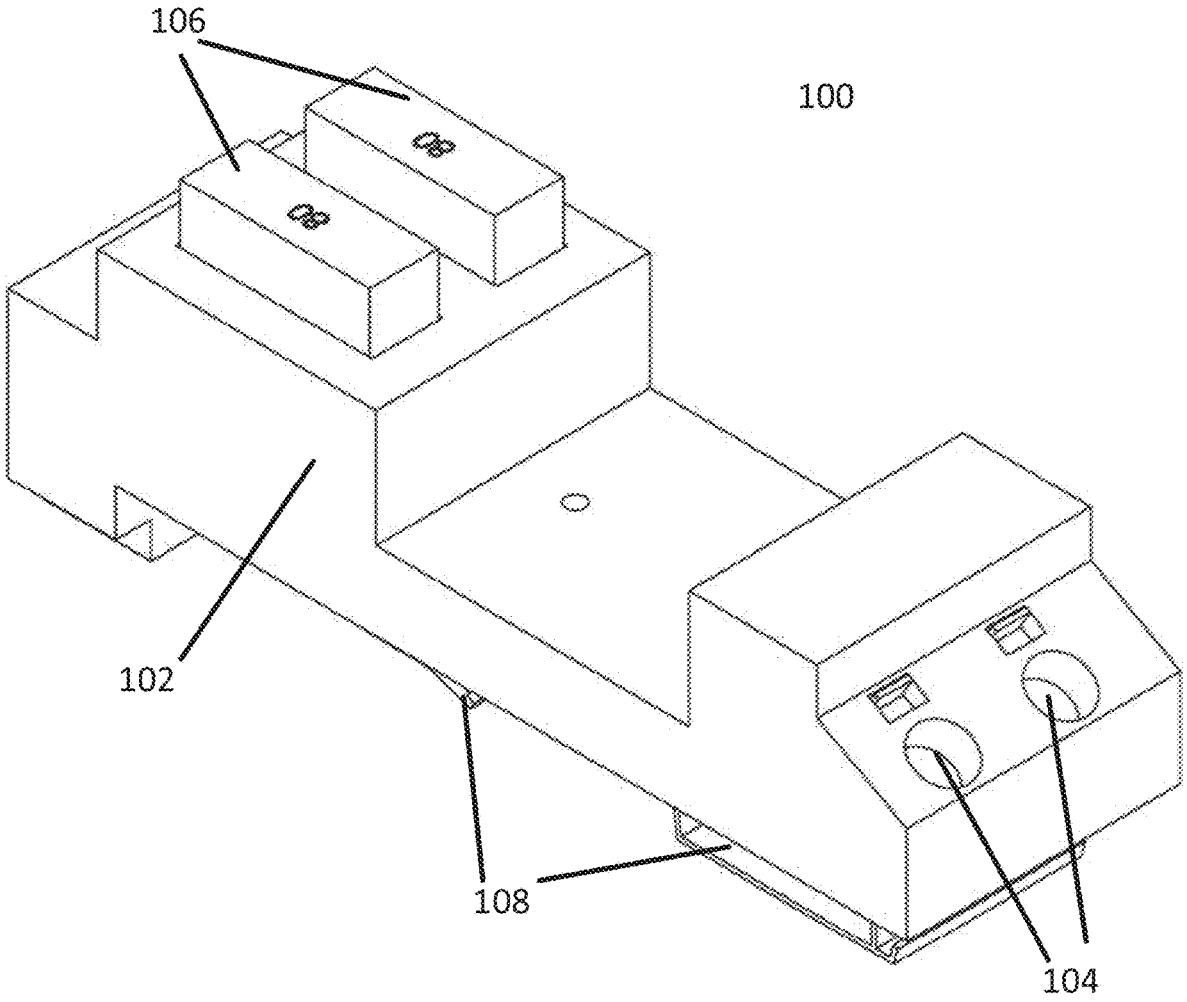
FIGS. 3A-3B illustrate a disconnect/test terminal block according to an embodiment of the invention.
Figure 3B:
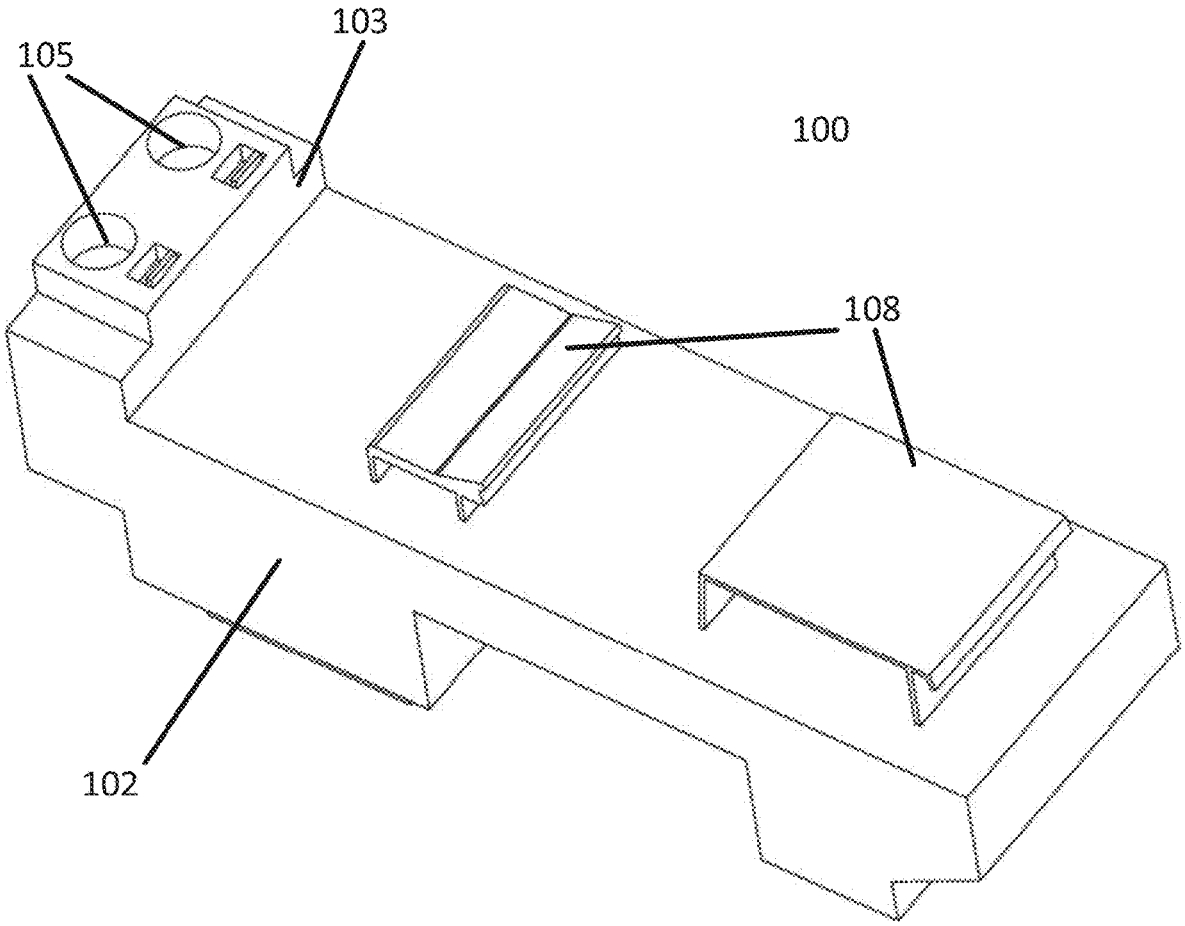

FIGS. 3A-3B illustrate a disconnect/test terminal block 100 according to an embodiment of the invention, where FIG. 3A shows a front side of block 100 and FIG. 3B shows a back side of block 100. Block 100 may include body 102 (which may house internal circuitry, not shown), case wire terminals 104 for coupling wires to block 100 and internal circuitry, test switches 106, and mounting hardware 108 for mounting block 100 to a DIN rail. Mounting hardware 108 may be coupled to internal circuitry to provide a ground path to the DIN rail when mounted thereto. Block 100 may include field cable terminals 105 for coupling wires to block 100 and internal circuitry. Field cable terminals 105 may be disposed on the back side of block 100. For example, field cable terminals 105 may be disposed on a protruding part 103 of body 102.

Figure 4:
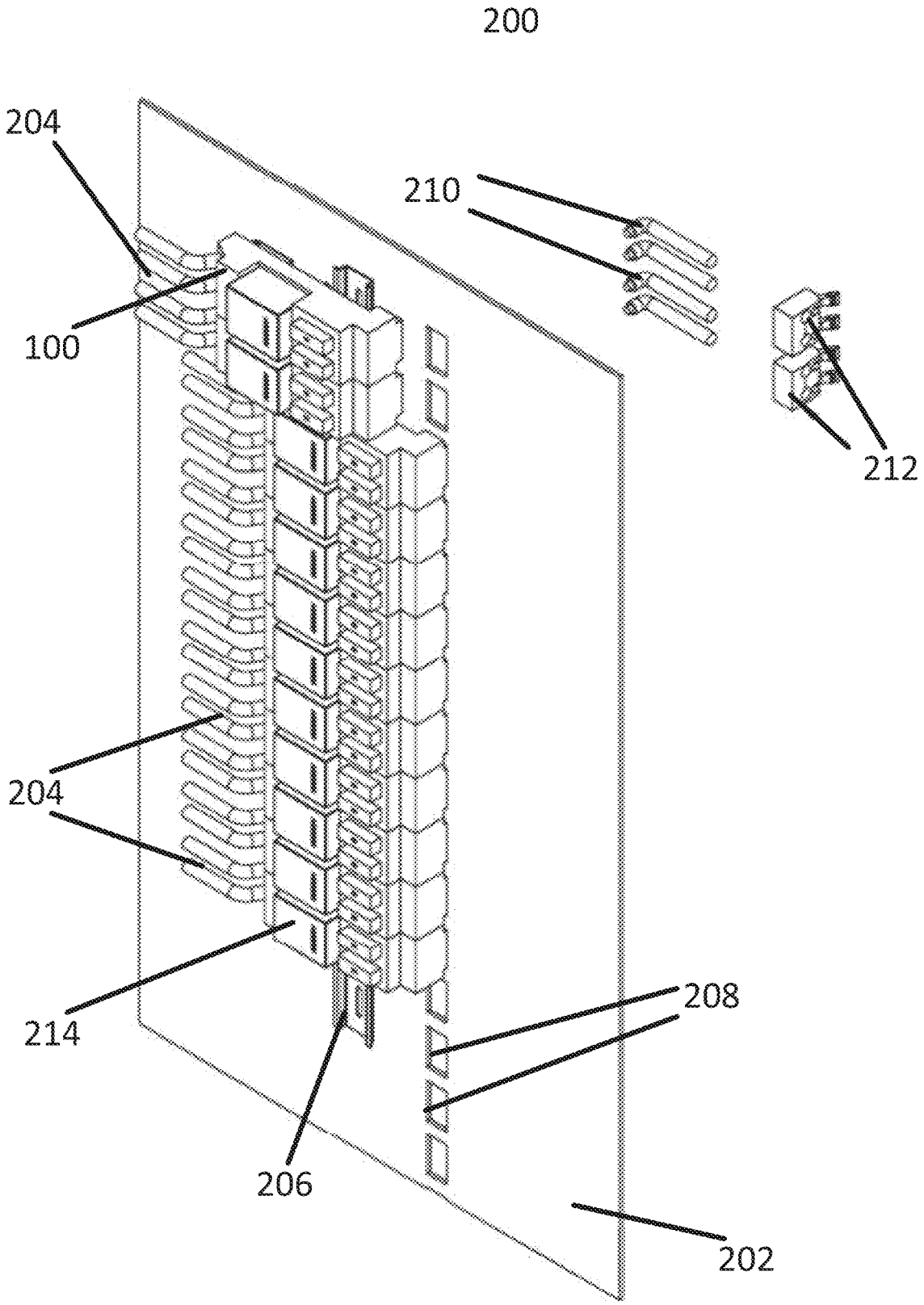
FIG. 4 illustrates a terminal board according to an embodiment of the invention.

FIG. 4 illustrates a terminal board 200 according to an embodiment of the invention. Terminal board 200 may include low impedance ground plane 202 and DIN rail 206 to which blocks 100 may be mounted. Case wire 204 may be coupled to terminals 104 of blocks 100, and arrestors 214 may be installed on each block 100. Ground plane 202 may include a plurality of holes 208, and protruding parts 103 of blocks 100 may fit into holes 208 and, in some cases, may protrude through holes 208. Accordingly, when blocks 100 are installed on DIN rail 206, field cable terminals 105 on protruding parts 103 may be accessible on a back side of ground plane 202. In other cases, protruding parts 103 may not protrude through holes 208, but may face and/or partially enter holes 208 so that field cable terminals 105 are accessible from the back side of ground plane 202. Field cables 210 may be held by field cable holders 212 (e.g., field cable holders 212 may secure field cables 210 in fixed positions and/or orientations in some embodiments). Field cables 210 may couple with field cable terminals 105. In the example of FIG. 4, each of field cables 210 may include a 90 degree (or approximately 90 degree) turn so that they may run parallel to ground plane 202 and turn to couple with field cable terminals 105 which may face perpendicular to ground plane 202. As shown in FIG. 4, due to the configuration of block 100, both the additional wire connection and feed through block are not needed.

Figure 5A:
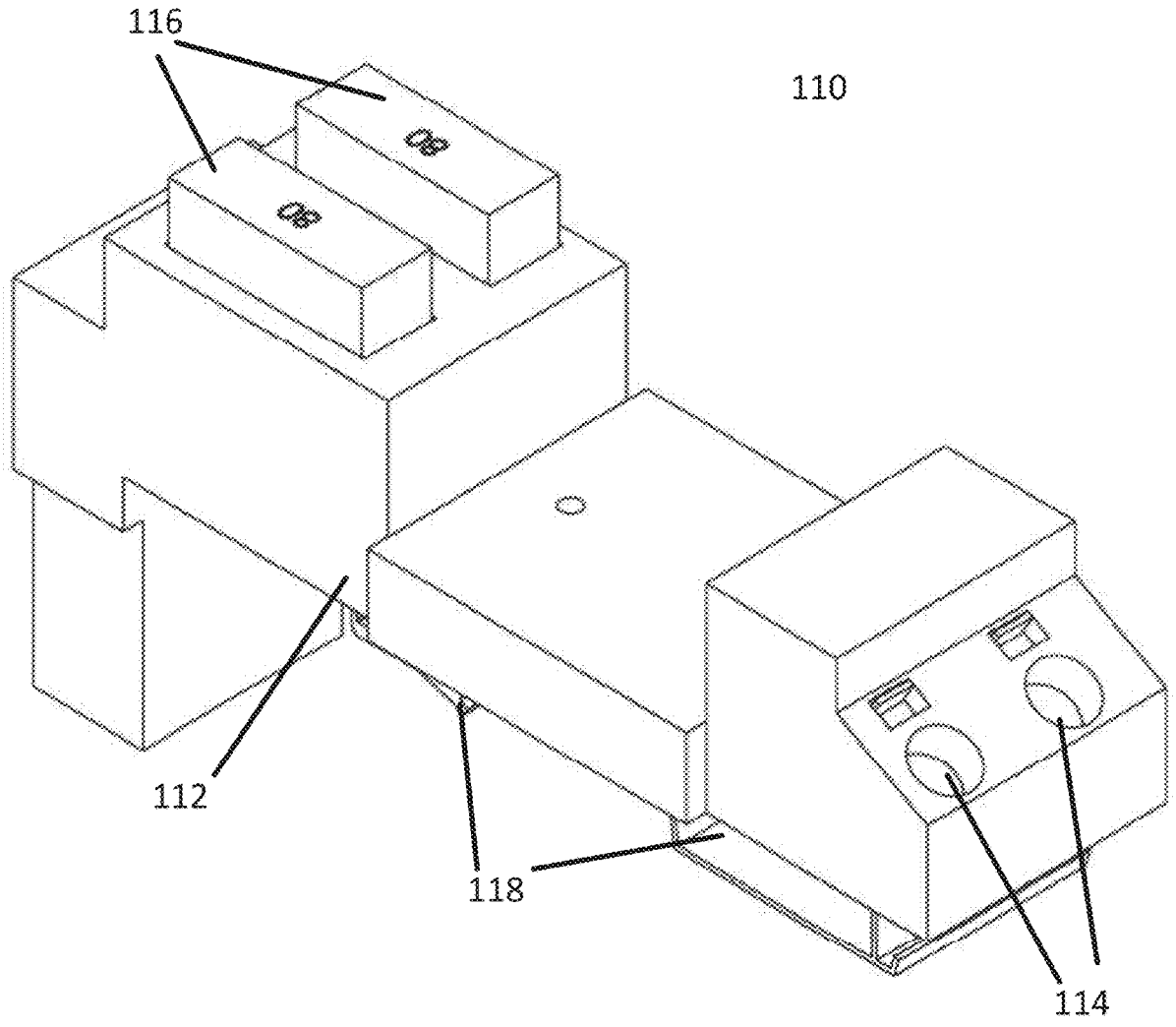
FIGS. 5A-5B illustrate a disconnect/test terminal block according to an embodiment of the invention.
Figure 5B:
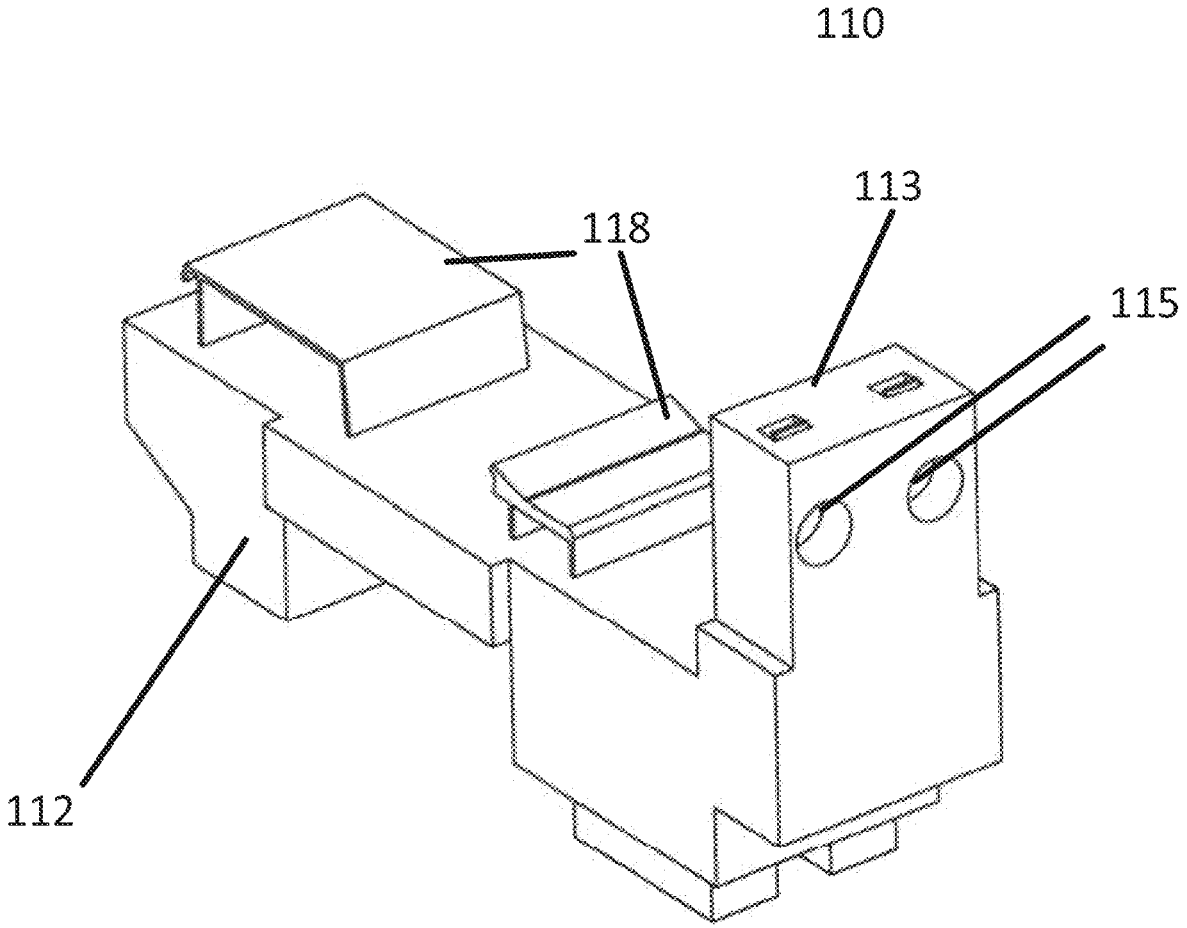

FIGS. 5A-5B illustrate a disconnect/test terminal block 110 according to an embodiment of the invention, where FIG. 5A shows a front side of block 110 and FIG. 5B shows a back side of block 110. Block 110 may be similar to block 100 of FIGS. 3A-3B, but may have a different configuration on the back side. For example, block 110 may include body 112 (which may house internal circuitry, not shown), case wire terminals 114 for coupling wires to block 110 and internal circuitry, test switches 116, and mounting hardware 118 for mounting block 110 to a DIN rail. Mounting hardware 118 may be coupled to internal circuitry to provide a ground path to the DIN rail when mounted thereto. Block 110 may include field cable terminals 115 for coupling wires to block 110 and internal circuitry. Field cable terminals 115 may be disposed on the back side of block 110. For example, field cable terminals 115 may be disposed on a protruding part 113 of body 112. Whereas block 100 may have field cable terminals 105 configured to face perpendicular to ground plane 202 when installed, block 110 may have field cable terminals 115 configured to face perpendicular to ground plane 222 when installed.

Figure 6:
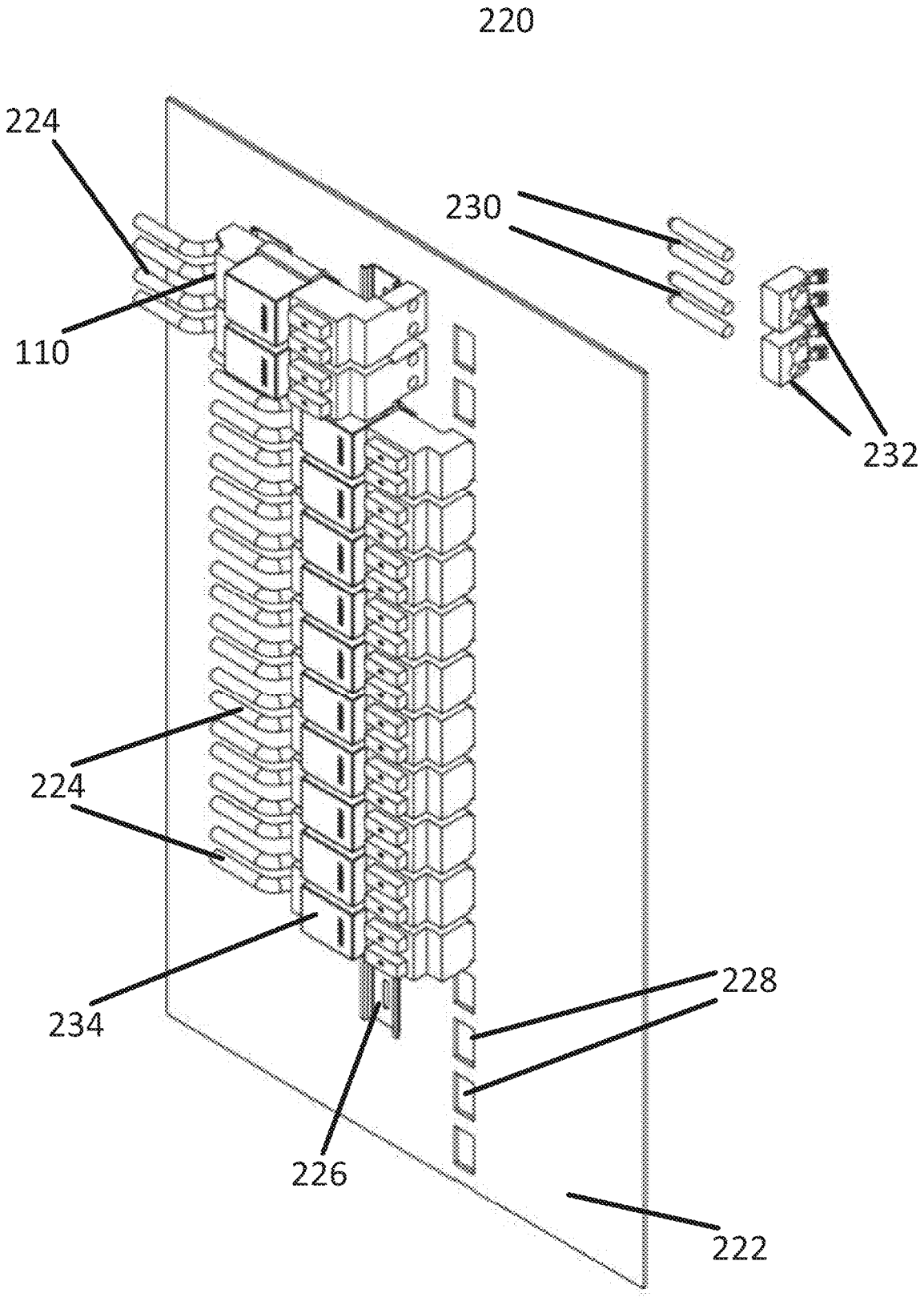
FIG. 6 illustrates a terminal board according to an embodiment of the invention.

FIG. 6 illustrates a terminal board 220 according to an embodiment of the invention. Board 220 may be similar to board 200 of FIG. 4, but may have a different field cable configuration. For example, terminal board 220 may include low impedance ground plane 222 and DIN rail 226 to which blocks 110 may be mounted. Case wire 224 may be coupled to terminals 114 of blocks 110, and arrestors 234 may be installed on each block 110. Ground plane 222 may include a plurality of holes 228, and protruding parts 113 of blocks 110 may fit into holes 228 and protrude through holes 228. Accordingly, when blocks 110 are installed on DIN rail 226, field cable terminals 115 on protruding parts 113 may be accessible on a back side of ground plane 222. Field cables 230 may be held by field cable holders 232 (e.g., field cable holders 232 may secure field cables 230 in fixed positions and/or orientations in some embodiments). Field cables 230 may couple with field cable terminals 115. In the example of FIG. 6, field cables 230 may not include a turn, as they may run parallel to ground plane 222 and couple with field cable terminals 115 which may face parallel to ground plane 202. As shown in FIG. 6, due to the configuration of block 110, both the additional wire connection and feed through block are not needed.

Figure 7A:
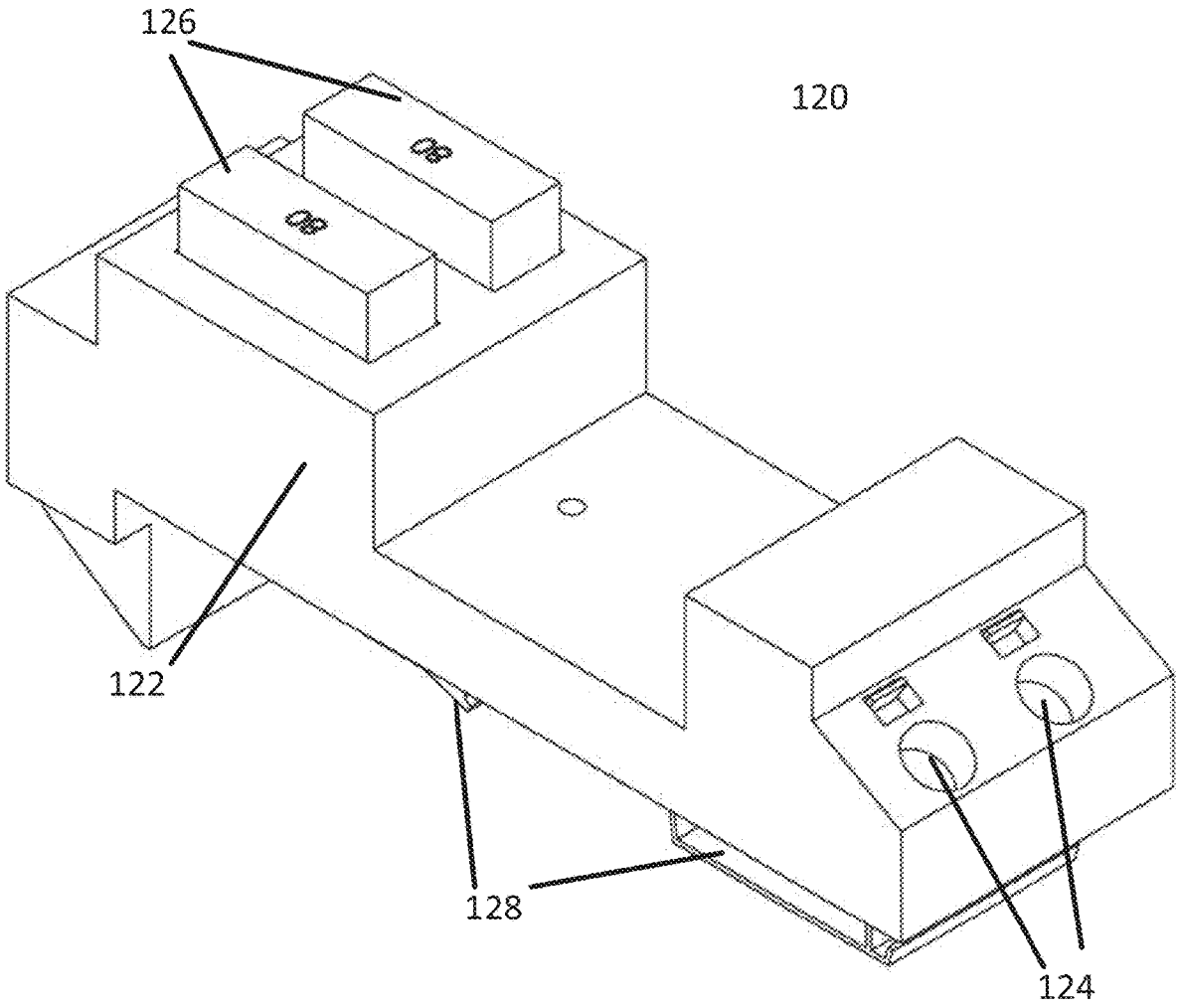
FIGS. 7A-7B illustrate a disconnect/test terminal block according to an embodiment of the invention.
Figure 7B:
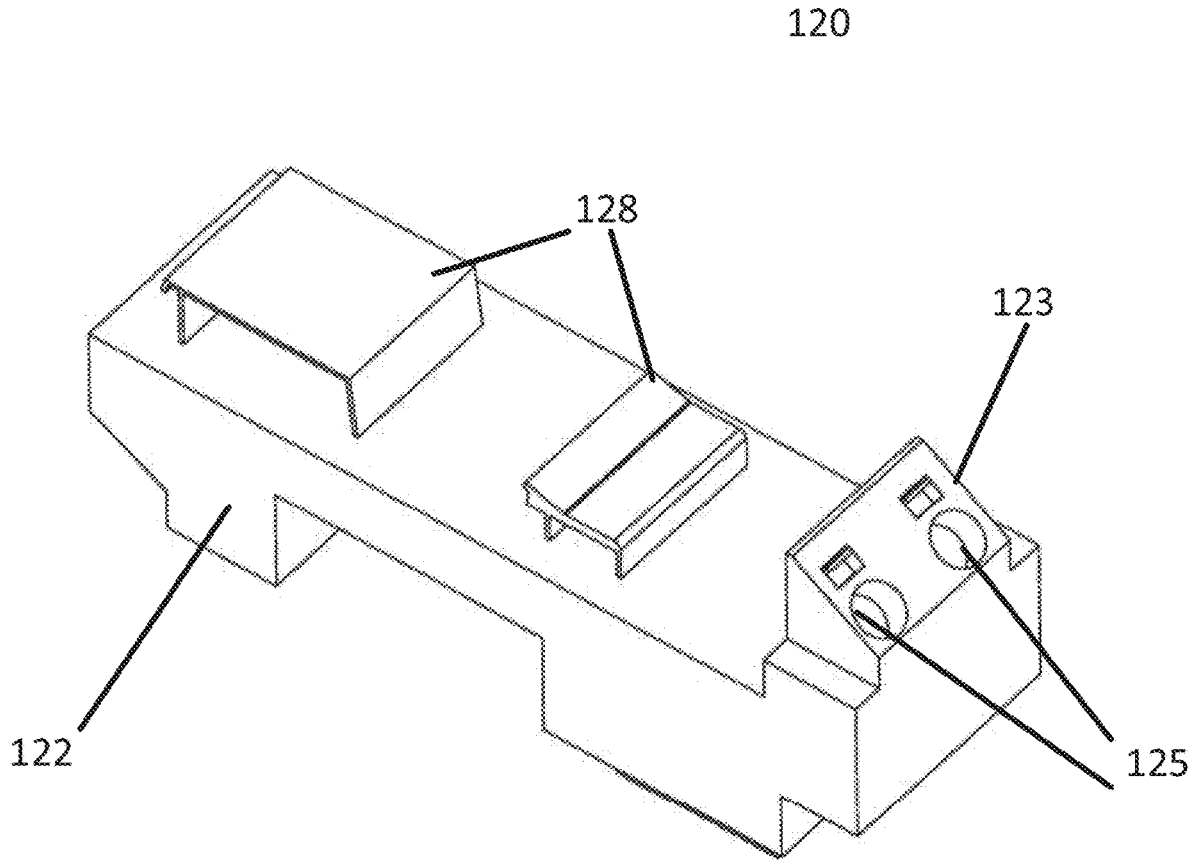

FIGS. 7A-7B illustrate a disconnect/test terminal block 120 according to an embodiment of the invention, where FIG. 7A shows a front side of block 120 and FIG. 7B shows a back side of block 120. Block 120 may be similar to block 100 of FIGS. 3A-3B, but may have a different configuration on the back side. For example, block 120 may include body 122 (which may house internal circuitry, not shown), case wire terminals 124 for coupling wires to block 120 and internal circuitry, test switches 126, and mounting hardware 128 for mounting block 120 to a DIN rail. Mounting hardware 128 may be coupled to internal circuitry to provide a ground path to the DIN rail when mounted thereto. Block 120 may include field cable terminals 125 for coupling wires to block 120 and internal circuitry. Field cable terminals 125 may be disposed on the back side of block 120. For example, field cable terminals 125 may be disposed on a protruding part 123 of body 122. Whereas block 100 may have field cable terminals 105 configured to face perpendicular to ground plane 202 when installed, block 120 may have field cable terminals 125 configured to face obliquely to ground plane 222 when installed.

Figure 8:
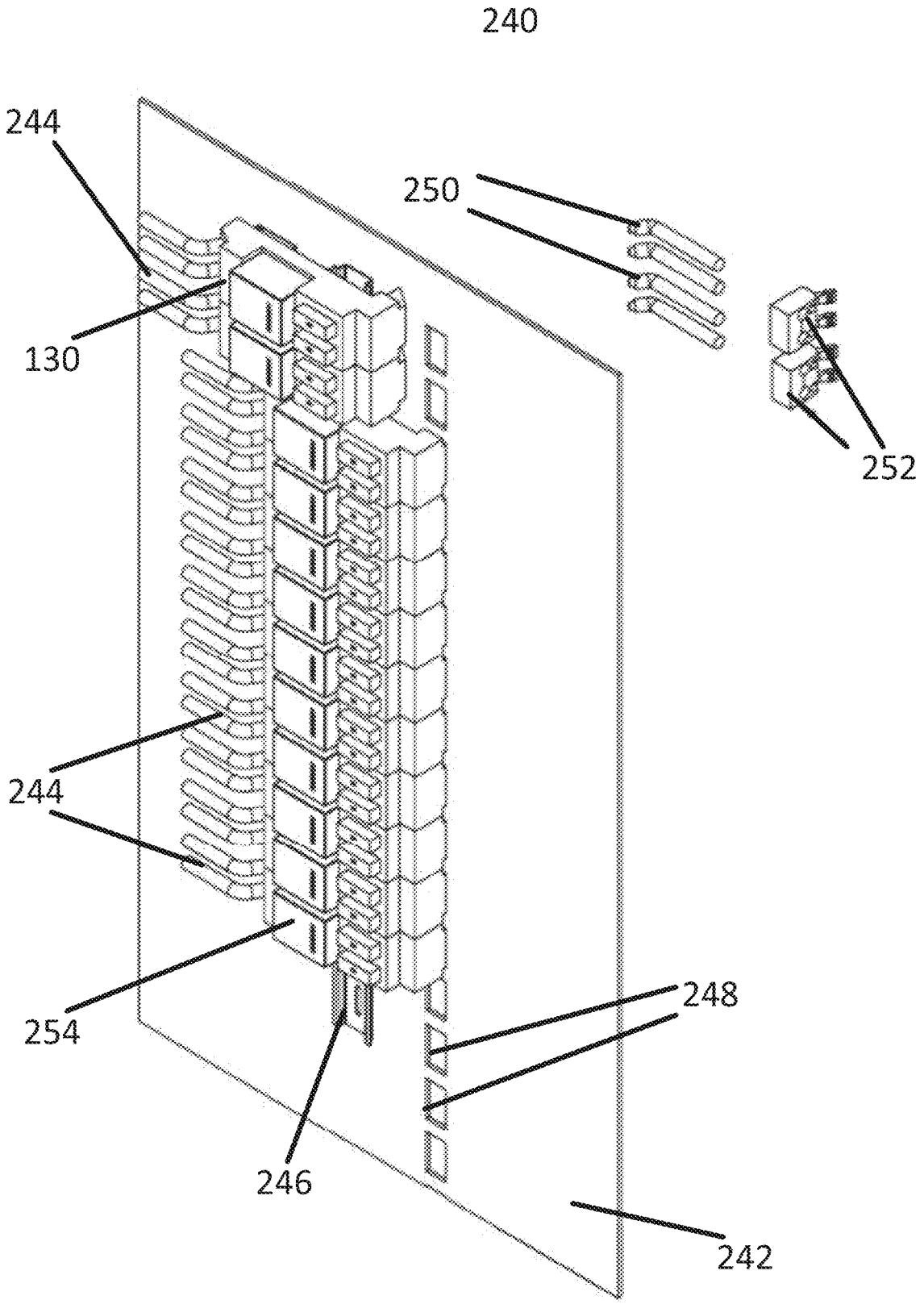
FIG. 8 illustrates a terminal board according to an embodiment of the invention.

FIG. 8 illustrates a terminal board 240 according to an embodiment of the invention. Board 240 may be similar to board 200 of FIG. 4, but may have a different field cable configuration. For example, terminal board 240 may include low impedance ground plane 242 and DIN rail 246 to which blocks 120 may be mounted. Case wire 244 may be coupled to terminals 124 of blocks 120, and arrestors 254 may be installed on each block 120. Ground plane 242 may include a plurality of holes 248, and protruding parts 123 of blocks 120 may fit into holes 248 and protrude through holes 248. Accordingly, when blocks 120 are installed on DIN rail 246, field cable terminals 125 on protruding parts 123 may be accessible on a back side of ground plane 242. Field cables 250 may be held by field cable holders 252 (e.g., field cable holders 252 may secure field cables 250 in fixed positions and/or orientations in some embodiments). Field cables 250 may couple with field cable terminals 125. In the example of FIG. 4, field cables 250 may include turns so that they may run parallel to ground plane 242 and turn to couple with field cable terminals 125 which may face obliquely to ground plane 242. The turns in field cables 250 may be angled to correspond to the angles of field cable terminals 125 so they may be coupled thereto. As shown in FIG. 8, due to the configuration of block 120, both the additional wire connection and feed through block are not needed.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. A disconnect/test terminal block for mounting to a terminal board, the disconnect/test terminal block comprising:

a body including:

a front side, and a back side including a protruding part;

at least one internal circuit disposed in the body;

at least one case wire terminal disposed on the front side of the body and coupled to the at least one internal circuit; and at least one field cable terminal disposed on the back side of the body on the protruding part and coupled to the at least one internal circuit, wherein, when the disconnect/test terminal block is mounted to the terminal board, a case wire terminates on a front of the terminal board via the at least one case wire terminal, and a field cable terminates on a back of the terminal board via the at least one field cable terminal.

2. The disconnect/test terminal block of claim 1, further comprising at least one test switch.

3. The disconnect/test terminal block of claim 1, wherein the protruding part is configured to fit inside a hole on a ground plane on which the disconnect/test terminal block is mounted.

4. The disconnect/test terminal block of claim 1, further comprising mounting hardware.

5. The disconnect/test terminal block of claim 4, wherein the mounting hardware is configured to mount the disconnect/test terminal block to a DIN rail.

6. The disconnect/test terminal block of claim 4, wherein the mounting hardware is coupled to the at least one internal circuit and configured to provide a ground path to an external ground.

7. A system comprising:

at least one disconnect/test terminal block, each at least one disconnect/test terminal block comprising:

a body including:

a front side, and a back side including a protruding part;

at least one internal circuit disposed in the body;

at least one case wire terminal disposed on the front side of the body and coupled to the at least one internal circuit;

at least one field cable terminal disposed on the back side of the body on the protruding part and coupled to the at least one internal circuit; and block mounting hardware;

a terminal board comprising:

a ground plane including:

a front side, a back side, and at least one hole protruding from the front side of the ground plane to the back side of the ground plane;

board mounting hardware coupled to the ground plane;

wherein the block mounting hardware of each at least one disconnect/test terminal block is coupled to the board mounting hardware; and wherein the protruding part of each at least one disconnect/test terminal block protrudes through the at least one hole in the ground plane, wherein, when the disconnect/test terminal block is mounted to the terminal board, a case wire terminates on a front of the terminal board via the at least one case wire terminal, and a field cable terminates on a back of the terminal board via the at least one field cable terminal.

8. The system of claim 7, further comprising at least one case wire disposed at the front side of the ground plane and coupled to the at least one case wire terminal.

9. The system of claim 7, further comprising at least one field cable disposed at the back side of the ground plane and coupled to the at least one field cable terminal.

10. The system of claim 7, wherein the board mounting hardware comprises at least one DIN rail.

11. The system of claim 7, wherein the block mounting hardware is coupled to the at least one internal circuit and configured to provide a ground path to the board mounting hardware.

12. The system of claim 7, wherein the at least one field cable terminal faces perpendicular to a plane parallel to the back side of the ground plane.

13. The system of claim 7, wherein the at least one field cable terminal faces parallel to a plane parallel to the back side of the ground plane.

14. The system of claim 7, wherein the at least one field cable terminal faces obliquely to a plane parallel to the back side of the ground plane.

* * * * *